US005632387A

United States Patent [19]

Johnson

[11] Patent Number: 5,632,387

[45] Date of Patent: May 27, 1997

[54] PEG RACKING DEVICE

[75] Inventor: M. H. (Mert) Johnson, Bloomington, Minn.

[73] Assignee: DIP Co., Bloomington, Minn.

[21] Appl. No.: 328,658

[22] Filed: Oct. 25, 1994

Related U.S. Application Data

[63] Continuation-in-part of Ser. No. 277,876, Jul. 20, 1994.

[51] Int. Cl.[6] ..... A47F 1/04

[52] U.S. Cl. ..... 211/59.1; 211/57.1; 211/106; 248/220.41

[58] Field of Search ..... 211/59.1, 57.1, 211/106; 248/220.3, 220.4, 221.1, 221.2, 222.2

[56] References Cited

U.S. PATENT DOCUMENTS

| | | | |
|---|---|---|---|
| 3,211,293 | 10/1965 | Tarnoff | 211/59 |
| 3,442,396 | 5/1969 | Cass | 248/220.3 |
| 3,638,801 | 2/1972 | Larson | 211/57 |
| 3,897,926 | 8/1975 | Silver | 248/221.1 |
| 4,066,169 | 1/1978 | Hochman | 211/57.1 |
| 4,362,249 | 12/1982 | Thalenfeld | 211/59.1 |
| 4,610,413 | 9/1986 | Pedersen | 248/220.3 |
| 4,823,964 | 4/1989 | Lundberg | 211/57.1 |
| 5,054,727 | 10/1991 | Campbell et al. | 248/220.3 |
| 5,348,167 | 9/1994 | Jensen | 211/57.1 |

FOREIGN PATENT DOCUMENTS

| | | | |
|---|---|---|---|
| 934767 | 7/1960 | United Kingdom | 248/220.4 |
| 477305 | 9/1963 | United Kingdom | 248/220.4 |

*Primary Examiner*—Leslie A. Braun
*Assistant Examiner*—Willie Berry, Jr.
*Attorney, Agent, or Firm*—Gregory P. Kaihoi

[57] ABSTRACT

A peg racking device for displaying merchandise. The peg racking device includes an elongated shaft having a bracket which is attachable to a wall, and a removable sleeve which is axially moveable along the shaft. The bracket includes lands and the rear end of the sleeve includes a notch with interface surfaces, the interface surfaces being engageable with the lands to align the sleeve and prevent rotational movement between the sleeve and the shaft. Either the sleeve or the shaft may include a bend located intermediate the rear and front ends to create an interference fit between the sleeve and the shaft, the sleeve being readily axially moveable along the shaft at least until the bend is encountered so that the sleeve frictionally contacts the shaft to prevent the sleeve from sliding off of the shaft as a package is removed from the peg.

5 Claims, 5 Drawing Sheets

Fig. 4
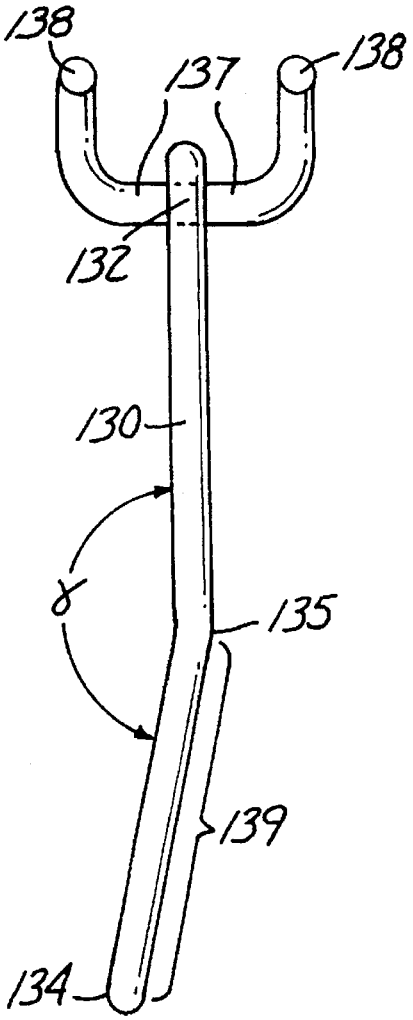
Fig. 6
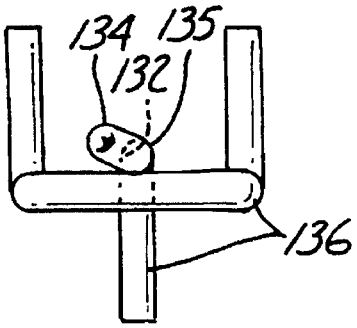
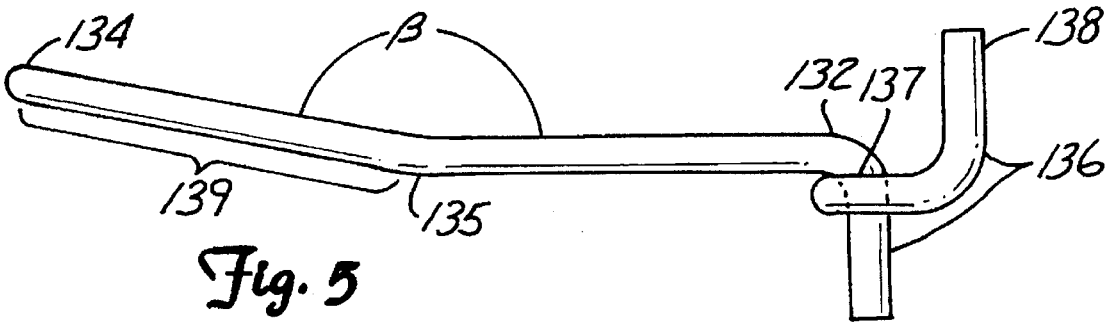
Fig. 5

PEG RACKING DEVICE

RELATED APPLICATION

This is a continuation-in-part of application Ser. No. 08/277,876, filed on Jul. 20, 1994, and entitled Peg Racking Device.

FIELD OF THE INVENTION

The present invention relates to pegs used in peg rocks for displaying merchandise in packages.

BACKGROUND OF THE INVENTION

Products in blister packaging or other packaging often are displayed on racks having a number of horizontally projecting pegs in various types of retail outlets such as department stores, sporting goods stores, automotive supply stores, hardware stores, drugstores and grocery stores. Each peg carries an individual type of product by placing the peg through a hole in the packaging. Usually the pegs are spaced as closely as possible to maximize the utilization of valuable retail space. Certain types of perishable stock such as meats, cheeses and vegetables must be rotated and sold on a first-in-first-out (FIFO) basis to reduce the amount of stock that perishes before it is sold.

One method of rotating stock is to remove the existing inventory from a peg, load the new inventory on the back of the peg, and then re-load the existing inventory on the peg. This method is costly not only because it is labor intensive, but also because it is tedious work and many stock persons simply load the new inventory on the front of the peg. Accordingly, the existing inventory often perishes on the back of the peg. It would be desirable, therefore, to provide a peg in which the inventory may be rotated without removing existing inventory, and which may be spaced as closely as possibly to other pegs.

U.S. Pat. No. 4,610,413 discloses a device for displaying packages having a peg support with a front hole and a back hole, the peg support being attached to a wall or the like; the peg has a body, a rear toe and a bottom flat engageable with the keyhole. The peg is attached to the peg support by reaching from the front of the pegs to the peg support attached to wall behind all of the products, and then threading the rear toe of the peg through the front hole and into the back hole. The peg is removed from the peg support by lifting the front of the peg and pulling the rear toe out of the back hole. New inventory may be placed on the back of the peg without having to remove the existing inventory by removing the peg from the peg support, loading the new inventory on the back of the peg, and then attaching the peg to the peg support. This system can be difficult to utilize, however, when the product packages are spaced closely together, particularly if there are many packages on a single peg-stock personnel can have a difficult time threading the rear toe into the rear hole, since adjacent packages tend to obstruct one's view. Also, the system requires vertically adjacent packages to be spaced from one another a sufficient distance so as to allow the front end of the peg to be lifted enough to disengage it from the rear hole.

U.S. Pat. No. 5,054,727 discloses a device for shipping, storing and racking packages that hang on pegs on display racks. The device includes a number of packages on a storage/transfer member within a container. An opening is provided along the longitudinal axis of the storage/transfer member to permit the member to be slid over a display rack peg. A group of packages are deposited on a peg by sliding the storage/transfer member over the peg, then holding the packages on the peg as the member is slid off of the peg. Conversely, a group of packages is removed from the peg by sliding the storage/transfer member over the peg and through the holes in the packages, raising a box or magazine up to the packages to support the packages and storage/transfer member, and then sliding the storage/transfer member off of the peg. The peg and storage/transfer member do not lock together, so the storage/transfer member typically has to be removed after it is installed to prevent the storage/transfer member from sliding off of the peg as consumers remove individual packages from the peg. The system is thus somewhat cumbersome to use.

U.S. Pat. No. 3,211,293 discloses a rack mounting device in which a number of packages may be loaded onto a peg in a single operation. The device includes a tube extending through the holes of a stack of products, and a rubber band for holding the stack onto the tube. The stack of products is loaded onto a peg by placing the tube over the front of the peg, releasing the rubber band, and then sliding the packages over the tube and onto the peg.

These and other proposed systems are typically cumbersome to utilize particularly when packages are closely spaced, and particularly if many heavy packages are held on a single peg. Thus, there is a need for a peg racking system that provides a convenient, easy-to-operate device in which new inventory may be added to a peg behind the existing inventory so that the inventory is sold on a FIFO basis.

SUMMARY OF THE INVENTION

The peg racking system of the present invention utilizes a peg having an elongated shaft with a front end, a rear end and a bent portion extending from the front end to an intermediate point along the length of the shaft. The rear end of the shaft is attachable either directly to a wall (e.g., a panel of pegboard) or to a bracket which in turn is attachable to a wall. A removable sleeve having a front end, a rear end and an interior wall defining a cavity for receiving the shaft is provided. The sleeve is axially moveable over at least part of the shaft until the rear end of the sleeve is positioned between the rear end and the intermediate point of the shaft; wherein the shaft frictionally contacts the interior wall of the sleeve to prevent to sleeve from sliding off of the shaft as packages are removed from the peg system.

In operation, new inventory is added to the back of the peg by first sliding the sleeve off of the shaft, carrying the existing inventory along with the sleeve. New inventory can then be placed on the back of the sleeve behind the existing inventory, and the sleeve can then be slid back over the shaft.

The present invention thus provides a peg racking system in which new inventory may be loaded easily on the back of the peg without removing the existing inventory from the front of the peg so that the inventory is sold on a FIFO basis. The system provides easy removal and re-loading of existing inventory without requiring vertical displacement of the peg, and the insertion point is located toward the front of the pegs so that stock personnel can easily align the two elements with respect to one another. The device further provides a handle for facilitating manipulation of the sleeve and the packages after the sleeve is removed from the shaft so that the packages do not fall off of the sleeve.

BRIEF DESCRIPTION OF THE DRAWINGS

FIG. 4 is a top view of shaft for a peg racking system of the invention having an interference fit;

FIG. 5 is a side elevational view of the shaft of FIG. 4;

FIG. 6 is a front elevational view of the shaft of FIG. 4;

DETAILED DESCRIPTION OF A PREFERRED EMBODIMENT

Figure 1:
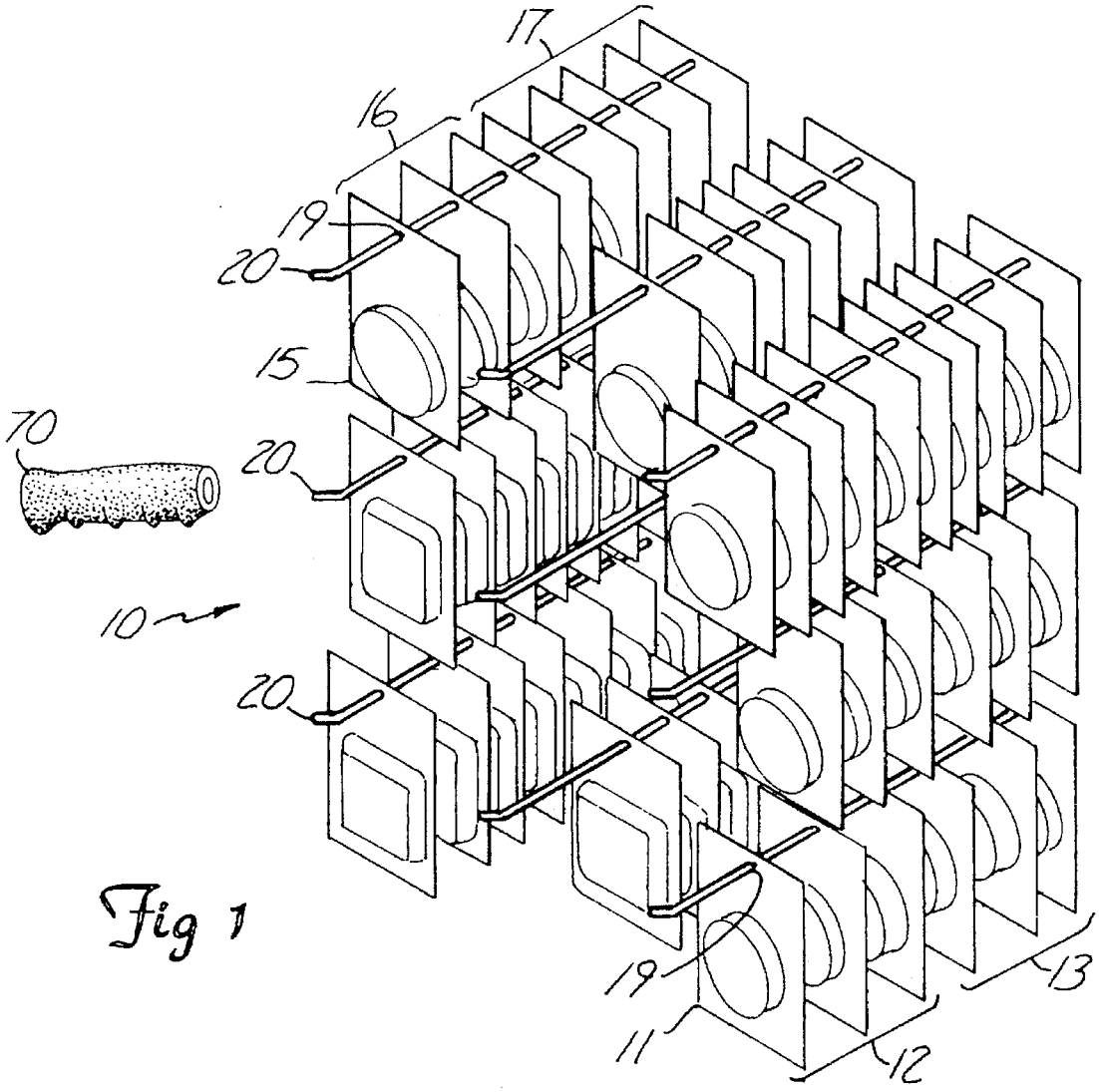
FIG. 1 is a perspective view of a peg racking system of the invention.

FIG. 1 depicts peg racking system 10 having a number of pegs 20 attached to a wall (not shown, though it may be any conventional type of pegboard or series of peg racking brackets). The pegs 20 project from the wall, and each peg 20 generally holds an individual type of packaged product 11, 15, by placing the peg 20 through a hole 19 in the package.

Figure 2:
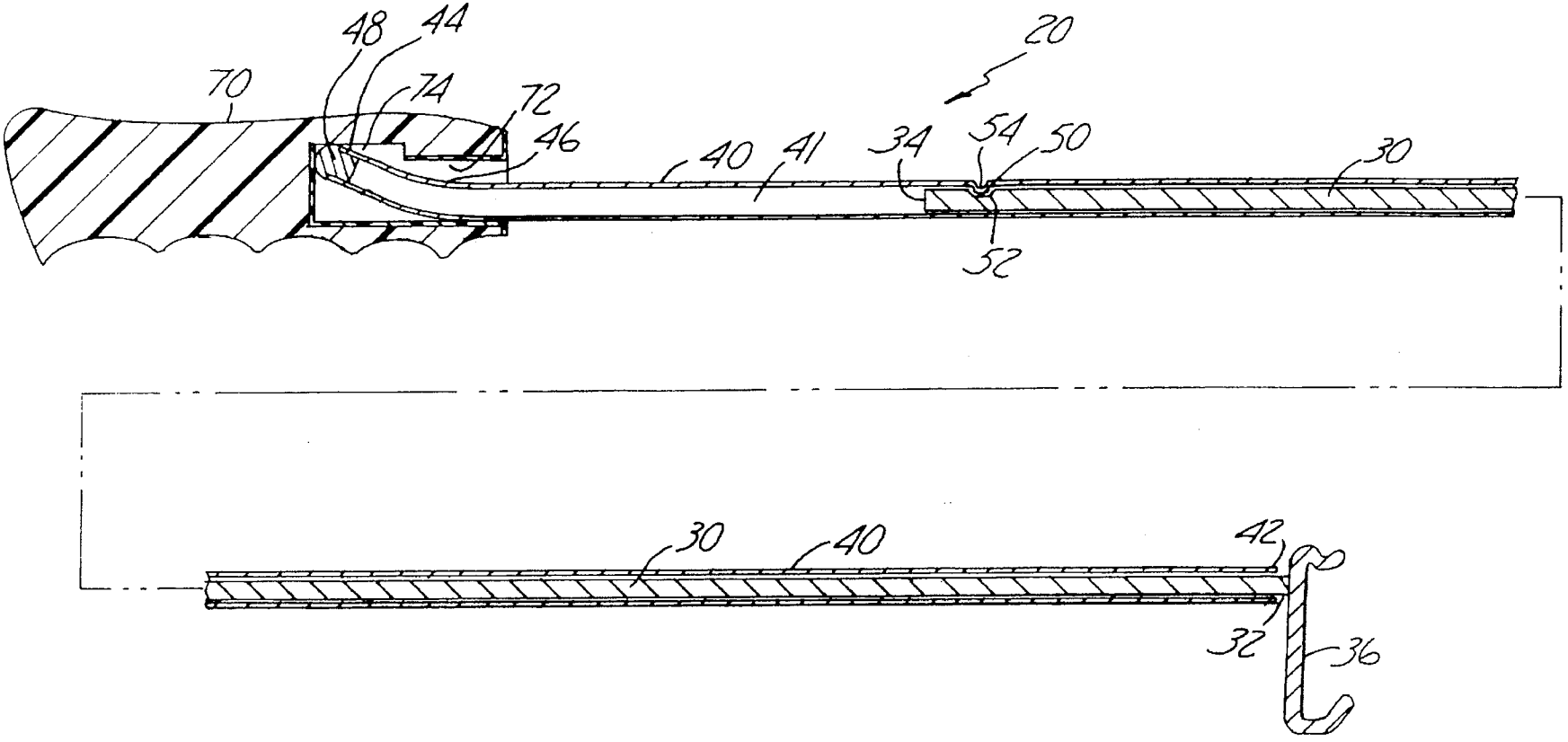
FIG. 2 is a cross-sectional view of a peg in accordance with the invention.

FIG. 2 shows a preferred embodiment of a peg 20, in which the peg 20 includes an elongated shaft 30 having rear and front ends 32, 34, respectively, and a removable sleeve 40. In a preferred embodiment, the transverse cross-section of the shaft is circular, though any other suitable shape may also be used. The rear end 32 of the elongated shaft 30 is attached to either a wall (not shown) or a bracket 36, the bracket 36 being attachable to a wall (typically by engaging a complementary bracket mounted to the wall). Preferably, the rear end 32 is attached to the bracket 36 so that the shaft 30 may be removed from, or re-positioned on, the wall. The bracket 36 may be C-shaped as shown, L-shaped, V-shaped or any other suitable shape that fixedly attaches the shaft 30 to the wall or complementary bracket. Also, the bracket 36 may be a separate piece as shown or it may be formed integrally with the shaft 30. The configuration of the bracket will depend upon the parameters defined by the mounting surface to which the shaft 30 is to be attached. It will be appreciated that the peg 20 of the present invention can be adapted to work in conjunction with almost any type of pegboard or wall by designing the bracket 36 to attach the shaft 30 to the particular pegboard or wall.

The removable sleeve 40 has rear and front ends 42, 44, respectively, and an elongated cavity 41 for receiving the shaft 30. The sleeve 40 is axially and rotationally moveable with respect to the shaft 30 so that the sleeve 40 may inserted over, or removed from, the shaft 30. The sleeve 40 may be removed from the shaft 30 by sliding the sleeve along the shaft until the rear end 42 of the sleeve moves past the front end 34 of the shaft. In a preferred embodiment, the front end 44 of the sleeve has an angled tip 46 to prevent packages from freely sliding off of the sleeve, and a plug 48 to close the cavity 41 at the front end 44 of the sleeve.

The peg 20 also includes a locking mechanism 50 having a first locking element 52 formed in the shaft 30 and a second complementary locking element 54 formed in the sleeve 40 (these elements of the locking mechanism are depicted as being formed in the respective components of the peg, but could also be separately manufactured and secured to the components of the peg). The first and second locking elements 52, 54, respectively, engage one another to prevent relative axial movement of the shaft 30 with respect to the sleeve 40. In a preferred embodiment, the first and second locking elements 52, 54 are positioned on the shaft 30 and sleeve 40, respectively, so that shaft 30 and the sleeve 40 are in a locked position when the rear end 42 of the sleeve is positioned substantially towards the rear end 32 of the shaft. By so positioning the sleeve 40 over substantially the full length of the shaft 30 in a locked position, the shaft 30 supports most (and preferably all) of the weight of the packages (not shown).

Figure 3:
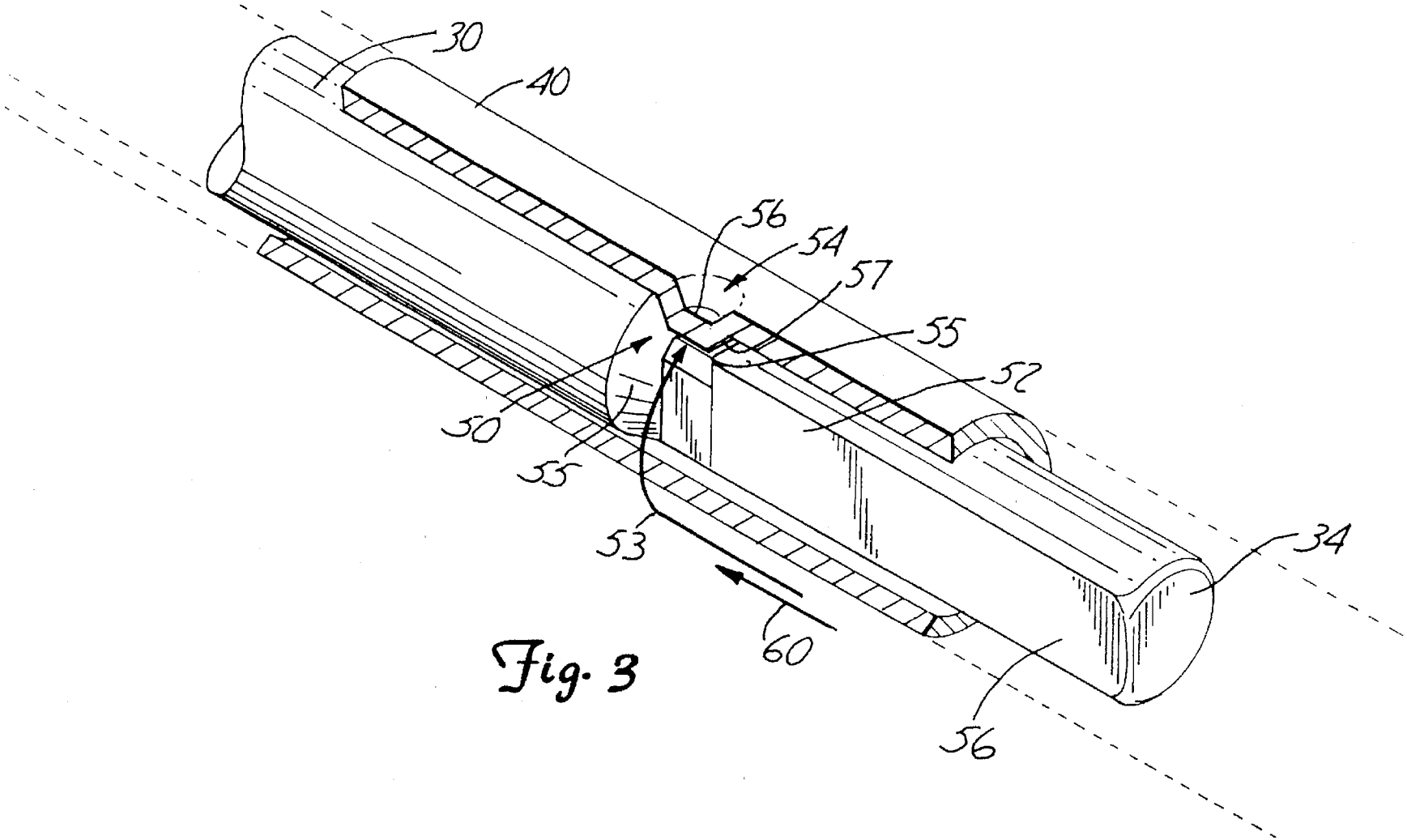
FIG. 3 is a cross-sectional view of a locking mechanism in accordance with the invention.

FIG. 3 depicts a preferred embodiment of the locking mechanism 50 with the first and second locking elements 52, 54 being engaged in the locked position. In this embodiment, the first locking element 52 includes a channel 55 and a recess 56 located near the front end 34 of the shaft 30. The channel 55 extends transversely around the shaft from the recess 56 to the top of the shaft 57. The recess 56 is a vertical face formed along the side of the shaft 30, extending from the channel 55 to the front end 34 of the shaft. The second locking element 54 is a complementary detent 58. To engage the first and second elements of the locking mechanism 50, the sleeve 40 is slid over the shaft 30 towards the wall with the detent 58 being initially aligned with the vertical face of the recess 56. As the sleeve 40 is slid along the shaft 30, the detent 58 moves along the recess in the direction of arrow 60 until it meets the channel 55, and then the sleeve 40 is rotated in the direction of arrow 53 so that the detent 58 moves along the channel 55 until it reaches the end of the channel. In a preferred embodiment, the end of the channel 55 is positioned so that the angled tip 46 of the sleeve 40 is oriented vertically upwardly with respect to the sleeve when the detent 58 cannot rotate any further. (The absolute angular orientations of the detent, channel and recess are not as important as their relative orientation with respect to one another.) The locking mechanism is disengaged by reversing the process described above.

Alternately, the first locking element could be a detent located near the rear end 32 of the shaft, and the second locking element could be an L-shaped groove with the body of the "L" longitudinally extending from the rear end 42 of the sleeve and the foot of the "L" extending transversely along the sleeve. In such an embodiment, the locking mechanism is engaged by aligning the body of the L-shaped groove with the detent on the shaft, axially sliding the sleeve 40 over the shaft 30 until the detent reaches the foot of the L-shaped groove, and then rotating the sleeve with respect to the shaft so that the detent travels in the foot of the L-shaped groove.

In yet another alternative embodiment, the first or second locking elements could be a spring biased pin, and the other element may be a pin receiving aperture. In such an embodiment, the sleeve may be slid over the shaft be depressing the pin; the shaft and sleeve may then be locked together by positioning the sleeve and shaft so that the pin is urged into the aperture under the force of the spring. Referring to FIGS. 1 and 2, a preferred embodiment of the peg racking system 10 includes a handle 70 for enhancing the user's ability to grip the sleeve 40. In a preferred embodiment, the handle 70 has a generally oval-shaped opening 72 and an internally enlarged cavity 74. The major axis of the oval opening 72 is slightly less than the height of the angled tip 46 and the interior cavity has a height slightly greater-than the angled tip 46. The handle 70 engages the angled tip 46 by allowing the uppermost portion of the angled tip 46 to extend into the enlarged interior cavity 74. The handle may enhances the user's ability to axially and rotationally grip and position the sleeve over the shaft. This is particularly valuable if the merchandise is relatively heavy, as, e.g., in the case of luncheon meats. The shape of the handle 70 and the sleeve receiving opening are defined by the shape of the sleeve 40.

It will be appreciated that the present invention is not limited to handles having an oval opening 72 and a cavity 74, but other shapes including circular, square, rectangular or any other suitable shape may be used, so long as they perform the function of assisting in manipulating the sleeve. In one preferred embodiment the opening is generally round and is provided with an O-ring (or similar resilient means), secured either to the end of the handle around the opening 72 or secured just inside the opening, for resiliently engaging the sleeve 40. Preferably the O-ring (or similar resilient means) has an internal diameter just slightly smaller than outer diameter of the sleeve 40 to create a snug fit, inhibiting unwanted relative movement of the sleeve with respect to the handle while permitting relatively easy insertion and withdrawal of the sleeve into and out of the handle during use.

The handle may be made from any suitable material that is durable and cost effective. Preferably, the handle is made from a relatively hard plastic, but it may be any other suitable material such as metal or wood. Alternately the handle may be made from a relatively flexible plastic such that the handle may be squeezed to functionally engage the sleeve so that the sleeve may be axially and rotationally positioned along the shaft.

Referring to FIGS. 1–3, the pegs 20 may be arranged in a peg racking system 10 to carry an inventory of many different products. FIG. 1 shows the lower right peg 20 holding a product 11, and the upper left peg holding a product 15. The present invention is especially useful for displaying perishable comestibles such as meats and cheeses, which can be relatively heavy. For example, product 11 may be a meat and product 15 may be a cheese being displayed in a refrigerator case of a grocery store. To simplify the description of the present invention, only the inventory management of the new and existing inventories 12, 13, respectively, of product 11 will be described. It will be appreciated that the peg system of the present invention will operate substantially the same regardless of the type of inventory carded by the pegs 20.

In use, existing inventory 12 illustrated in the drawings is disposed on the sleeve 40 and the shaft 30 and the sleeve 40 are in the locked position. New inventory 13 is added to the back of the peg by disengaging the locking mechanism 50 and sliding the sleeve 40, and the existing inventory 12 that is carded by the sleeve, off of the shaft 30. The new inventory 13 is then placed over the rear end 42 of the sleeve 40 so that the existing inventory 12 is at the front end 44. The rear end 42 of the sleeve 40 is then inserted over the front end 34 of the shaft 30, and the sleeve 40 is moved axially along the shaft until the first and second locking elements engage one another to lock the sleeve and shaft together. In a preferred embodiment, the handle 70 may be used to positively grip the sleeve 40, which reduces the risk of dropping the sleeve after it is removed from the shaft while enhancing the user's ability to rotate and axially move the sleeve relative to the shaft.

The present invention offers several advantages, the first of which is that inventory may be easily rotated so that it can be sold on a FIFO basis. Another advantage is that the pegs may be placed very closely together because they may be removed without any vertical movement of the front end of the peg. Yet another advantage is that the sleeves can be inserted over the pegs out in front of the packages instead of behind the packages where it is difficult to thread the back end of the peg into a series of holes. Moreover, the sleeve may be easily manipulated because the handle affords the user a better grip.

FIGS. 4–8 show another preferred embodiment of the invention. FIGS. 4–6 show an elongated shaft 130 having rear and front ends 132, 134, respectively. The shaft 130 has a bent portion 139 extending from the front end 134 to an intermediate point 135. The shaft 130 may be bent in any number of planes, including: 1.) the horizontal plane at an angle $\alpha$ as shown in the top elevational view of FIG. 4; 2.) the vertical plane at an angle $\beta$ as shown in the side elevational view of FIG. 5; or 3.) both the horizontal and vertical planes as shown in the front elevational view of FIG. 6. In a preferred embodiment, the amount of the bend is preferably about 1°–5° (i.e., the angles $\alpha$ and $\beta$ are about 175°–179°) and the intermediate point 135 is positioned towards the front end 134 of the shaft 130 (in the drawings the bend is exaggerated for purposes of illustration only).

The rear end 132 of the shaft is shown connected to a bracket 136, yet the shaft may also be directly connected to a wall (e.g., a panel of pegboard). The bracket 136 includes a number of lands 137 positioned radially outwardly from the shaft 130. The bracket 136 is preferably made from a downwardly projecting extension of the rear end 132 of the shaft, and a U-shaped rod having upwardly extending portions 138 from the legs of the "U".

Figure 7:
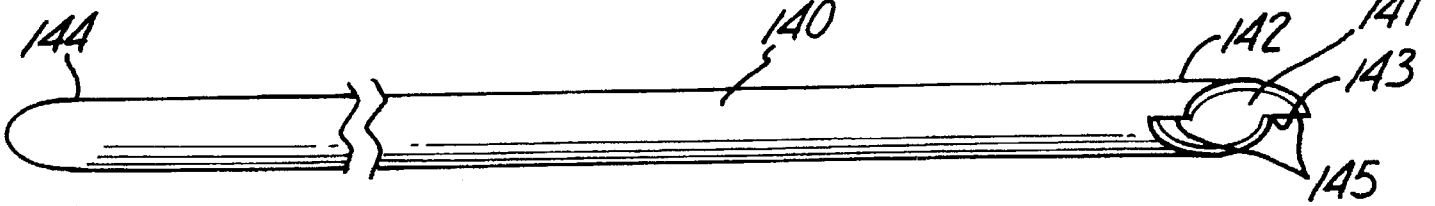
FIG. 7 is a perspective view of a sleeve for a peg racking system in accordance with the invention, having an interference fit.
Figure 8:
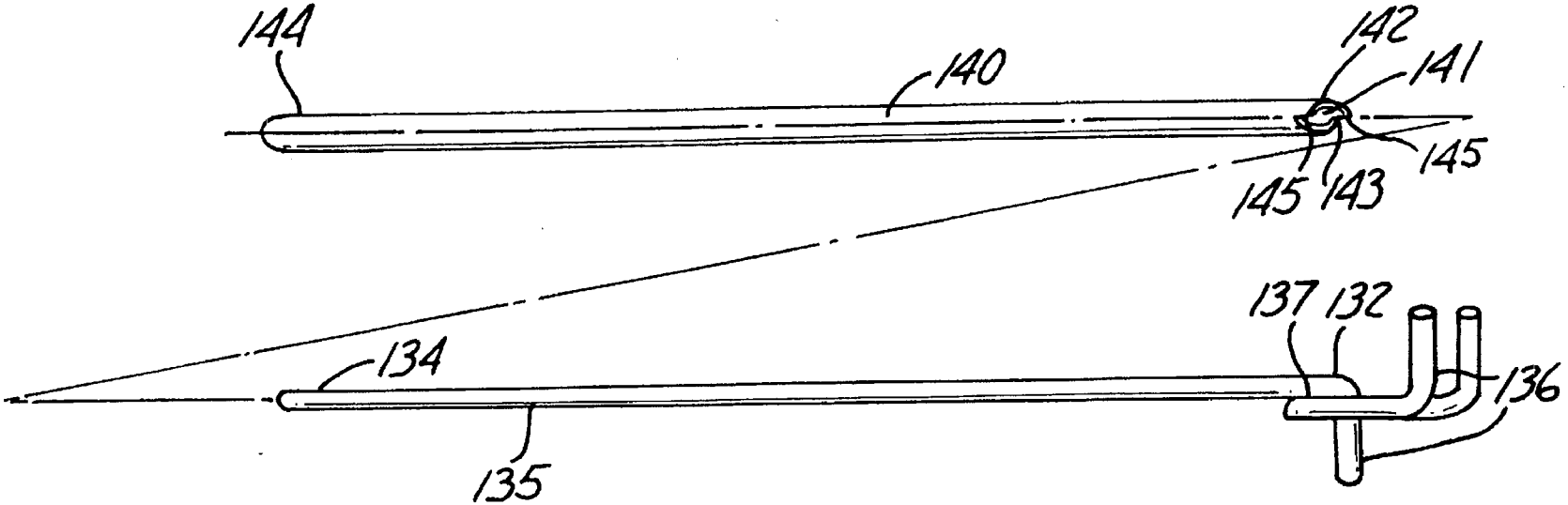
FIG. 8 is a perspective view of a peg racking system in accordance with the invention having an interference fit.

FIG. 7 and 8 depict a removable sleeve 140 for use with the rod 130. The removable sleeve 140 has rear and front ends 142, 144, respectively, and an interior wall defining an elongated cavity 141 for receiving the shaft 130. The cross-sectional size of the cavity 141 is only slightly larger than the cross-sectional size of the front end 134 of the shaft 130 so that the sleeve 140 cannot freely slide along the shaft 130 after the rear end 142 of the sleeve engages the portion of the shaft 130 between its rear end 132 and the intermediate point 135. The rear end of the sleeve 140 includes at least one notch 143 creating an interface surface 145 on either side of the sleeve.

In operation, the sleeve 140 is slid over the length of the shaft 130 until the rear end 142 of the sleeve is positioned at the rear end 132 of the shaft. As the sleeve 140 is slid over the shaft 130, the bent portion 139 causes a frictional interference fit between the sleeve 140 and the shaft 130 which prevents the sleeve 140 from freely sliding along the shaft 130 as packages are removed from and placed on the peg. Also, when the rear end 142 of the sleeve is positioned at the rear end 132 of the shaft, the interface surfaces 145 of the notch 143 rest against the lands 137 to align the sleeve and prevent rotational movement between the sleeve and the shaft.

The actual amount that the shaft 130 is bent depends upon the cross-sectional size of the shaft 130, the cross-sectional size of the cavity 141, the length of the interface between the shaft and the sleeve, and the frictional force necessary to sustain the sleeve on the shaft as the packages are removed from the peg. It will be appreciated that the degree of the bend is large enough to create sufficient friction between the shaft and sleeve to hold the sleeve in place as the packaged items are removed from the peg. Yet, the bend is also small enough to allow the sleeve to be slid over the shaft until the rear end of the sleeve is positioned at the rear end of the shaft.

In one alternative embodiment of the peg having an interference fit (not shown), the shaft is straight and the sleeve has a bent portion extending from the front end of the sleeve to an intermediate upon the length of the sleeve. In this alternative embodiment, the frictional interference fit occurs when the front portion of the shaft is positioned between the front end of the sleeve and the intermediate point along the length of the sleeve.

In still another alternative embodiment of the peg having an interference fit (not shown), a number of lands may be positioned at the rear end of the shaft. In this embodiment, the lands may be opposing sides of one or more radial extensions that are engageable with corresponding interface surfaces on the sleeve.

While a preferred embodiment of the present invention has been described, it should be understood that various changes, adaptations and modifications may be made therein without departing from the spirit of the invention and the scope of the appended claims.

What is claimed is:

1. A peg racking device, comprising:

an elongated shaft having a front end, a rear end and a bent portion from the front end to an intermediate point along the length of the shaft a bracket connected to the rear end of the shaft for removably attaching the shaft to a wall; and a removable sleeve having a front end, a rear end and an interior wall defining a cavity for receiving the shaft, the sleeve being axially moveable along the shaft at least until the rear end of the sleeve is positioned between the rear end of the shaft and the intermediate point, wherein the shaft frictionally contacts the interior wall of the sleeve to prevent the sleeve from sliding off of the shaft as a package is removed from the peg the bracket including lands and the rear end of the sleeve including a notch with interface surfaces, the interface surfaces being engageable with the lands to align the sleeve and prevent rotational movement between the sleeve and the shaft.

2. A peg racking device, comprising:

an elongated shaft having front and a rear ends a bracket connected to the rear end of the shaft for removably attaching the shaft to a wall;

a removable sleeve having a front end, a rear end, and an interior cavity for closely receiving the shaft, one of the sleeve and the shaft including a bend located intermediate the rear and front ends to create an interference fit between the sleeve and the shaft, the sleeve being readily axially moveable along the shaft at least until the bend is encountered, whereby the sleeve frictionally contacts the shaft to prevent the sleeve from sliding off of the shaft as a package is removed from the peg;

the bracket including lands and the rear end of the sleeve including a notch with interface surfaces, the interface surfaces being engageable with the lands to align the sleeve and prevent rotational movement between the sleeve and the shaft.

3. A peg racking device, comprising:

an elongated shaft having front and rear ends;

a removable sleeve having a front end, a rear end and an interior wall defining a cavity for receiving the shaft therein, the sleeve being axially moveable along the shaft;

a bracket connected to the rear end of the shaft for removably attaching the shaft to a wall, the bracket including lands and the rear end of the sleeve including a notch with interface surfaces, the interface surfaces being engageable with the lands to align the sleeve and prevent rotational movement between the sleeve and the shaft.

4. A peg racking device, comprising:

an elongated shaft having front and rear ends;

a removable sleeve having a front end, a rear end and an interior wall defining a cavity for receiving at least the front end of the shaft therein, the sleeve being axially moveable along the shaft;

the rear end of the shaft including radially extending lands and the rear end of the sleeve including a notch with interface surfaces, the interface surfaces being engageable with the lands to align the sleeve and prevent rotational movement between the sleeve and the shaft.

5. A peg racking device, comprising:

an elongated shaft having front and a rear ends, the rear end of the shaft having an attachment means theron for attachment to a wall;

a removable sleeve extending substantially along the full length of the shaft from said front and to said attachment means of said rear end, the sleeve having a front end, a rear end, and an interior cavity for closely receiving the shaft, one of the sleeve and the shaft including a bend located intermediate the rear and front ends to create an interference fit between the sleeve and the shaft, the sleeve being readily axially moveable along the shaft from said first end toward said second end at least until the bend is encountered, whereby the sleeve frictionally contacts the shaft at said bend to prevent the sleeve from sliding off of the shaft as a package is removed from the peg and whereby said sleeve may be removed from said shaft while carrying packages and permitting new packages to be placed on said shaft prior to reassembly.

* * * * *